US006398701B1

(12) United States Patent
Mohrmann

(10) Patent No.: US 6,398,701 B1
(45) Date of Patent: Jun. 4, 2002

(54) CYLINDER FOR A ROTARY PRESS

(75) Inventor: Hans Dierk Mohrmann, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/331,161

(22) PCT Filed: Dec. 19, 1997

(86) PCT No.: PCT/DE97/02982

§ 371 (c)(1),
(2), (4) Date: Aug. 20, 1999

(87) PCT Pub. No.: WO98/28141

PCT Pub. Date: Jul. 2, 1998

(30) Foreign Application Priority Data

Dec. 20, 1996 (DE) ..... 196 53 404

(51) Int. Cl.[7] ..... B25F 5/02

(52) U.S. Cl. ..... 492/39; 492/16; 492/18; 100/155 R; 29/895.21; 29/895.2

(58) Field of Search ..... 492/39, 18, 16; 100/155 R, 170, 176; 29/895.2, 895.21, 895.3

(56) References Cited

U.S. PATENT DOCUMENTS

| | | | | | |
|---|---|---|---|---|---|
| 4,062,096 | A | * | 12/1977 | Eibe | 29/113 AD |
| 5,031,435 | A | * | 7/1991 | Seto et al. | 72/247 |
| 5,095,601 | A | * | 3/1992 | Buchegger | 29/117 |
| 5,123,606 | A | * | 6/1992 | Braun et al. | 242/72.1 |
| 5,327,762 | A | * | 7/1994 | Nagamine et al. | 72/247 |
| 5,483,812 | A | * | 1/1996 | Dempsey | 72/252.5 |
| 5,599,264 | A | * | 2/1997 | Hashimoto et al. | 492/39 |
| 5,979,305 | A | * | 11/1999 | Wadzinski | 100/38 |
| 6,038,907 | A | * | 3/2000 | Willems et al. | 72/247 |
| 6,042,525 | A | * | 3/2000 | Rajaniemi | 492/39 |
| 6,216,940 | B1 | * | 4/2001 | Sugano et al. | 228/147 |

FOREIGN PATENT DOCUMENTS

| | | | |
|---|---|---|---|
| DE | 427 088 C | * | 3/1926 |
| DE | 11 93 066 b | * | 5/1965 |
| DE | 27 45 086 A | * | 4/1979 |
| DE | G 9005141.6 | | 6/1991 |
| DE | 196 28647 A | * | 1/1998 |
| JP | 9314808 | | 12/1997 |

* cited by examiner

*Primary Examiner*—I Cuda Rosenbaum
(74) *Attorney, Agent, or Firm*—Jones, Tullar & Cooper, PC

(57) ABSTRACT

A cylinder for a rotary printing press can be subdivided into a plurality of sections in a first operational mode. In a second operational mode, the cylinder has a functionally continuous outer surface.

4 Claims, 4 Drawing Sheets

3
9
27
7
12
1
11
28
9
4

27
1
22
28
23

19
27
21
1
28

19
l 19
27
21
l 21
1
22
l 22
28
23
l 23

CYLINDER FOR A ROTARY PRESS

FIELD OF THE INVENTION

The invention relates to a cylinder for a rotary printing press.

Description of the Prior Art

DE-PS 875 205 describes a cylinder with several individual sleeve-like cylinders arranged on a common shaft.

It is disadvantageous in connection with this cylinder that the individual cylinders cannot form an uninterrupted surface.

DE 27 45 086 A1 describes an ink duct cylinder for containing different inks in adjacent areas, whose barrels have circular separating grooves. These separating grooves can be filled with a flexible tape.

DE-AS 11 93 066 discloses a cylinder, whose barrel consists of three displaceable sections.

Later-published DE 196 28 647 A1 shows an ink transport roller, whose register can be closed.

SUMMARY OF THE INVENTION

It is the object of the invention to create a cylinder.

The advantages which can be attained by-means of the invention reside in particular in that a barrel of a cylinder can be selectively divided into sections. In this way it is possible, for example, to adapt the cylinder to a plurality of plates placed at a distance next to each other, without it being necessary to change cylinders. Accumulations of ink in the area of the spaces between the plates are prevented. Printing disruptions are reduced by this and the print quality is increased.

The cylinder is divided into individual sections, which can be displaced relative to each other, by means of which an exact demarcation of an end of the respective section is possible. Also, a distance between the sections can be changed, for example in a continuously variable manner.

The cylinders can be remotely controlled, i.e. they can also be adjusted while the press is running, for example.

The cylinder in accordance with the invention for a rotary printing press is represented in the drawings and will be described in greater detail in what follows.

BRIEF DESCRIPTION OF THE DRAWINGS

Shown are in.

DESCRIPTION OF THE PREFERRED EMBODIMENT

Figures 1, 2, 3, 4:
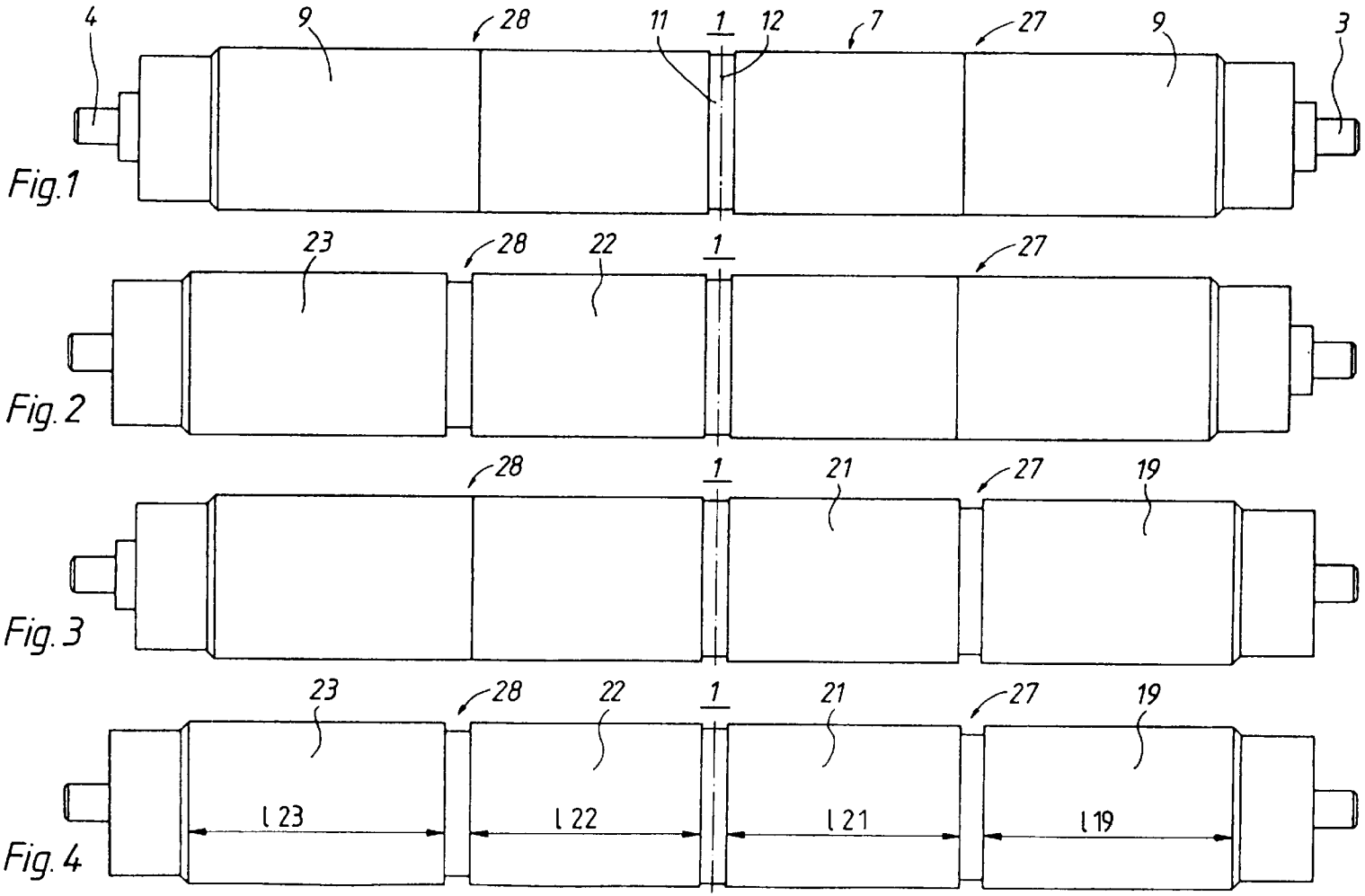
FIGS. 1 to 4, schematic representations of a first type of a cylinder in various operating positions.

A cylinder 1 essentially has two journals 3, 4 and a barrel 7. The journals 3, 4 are stationary fastened, for example in relation to lateral frames, not represented, and the barrel 7 is rotatably seated on the journals 3, 4. In the present exemplary embodiments, a surface area 9 of the barrel 7 is provided with a circular groove 11 in its center, so that the cylinder 1 is designed approximately axis-symmetrically in respect to a center line 12 of this groove 11. This cylinder 1 preferably is an ink or moisture application cylinder of a rotary printing press cooperating with a plate cylinder, or respectively a distributing cylinder between undivided ink application cylinders.

The barrel 7 of this cylinder 1 is coated, for example, with a rubber-elastic cover 13, for example caoutchouc or an elastomer. Viewed in the axial direction, the plate cylinder is provided with a plurality of plates placed next to each other. For example, two"half width", or one "half width" and two "quarter width", or four "quarter width" plates can be selectively placed on this plate cylinder.

The cylinder 1 is adaptable in accordance with a selected coverage of the plate cylinder, i.e. the surface area 9 of the barrel 7 can be divided into individual sections 19, 21, 22, 23.

Thus, in the axial direction the barrel 7 of the cylinder 1 has a selectable number of cylindrical sections 19, 21, 22, 23, whose length 119, 121, 122, 123 is matched to the width of the associated printing plate.

FIG. 1 represents the cylinder 1, which is divided into two halves 27, 28 by the grove 11, in an initial position.

FIG. 2 shows the cylinder 1, whose left half 28 of the barrel 7 has two sections 22, 23, in a second position.

In FIG. 3, the cylinder 1 is in a third position, wherein the right half 27 of the barrel 7 is divided into two sections 19, 21.

In the fourth position of the cylinder 1 in FIG. 4, the right half 27 and the left half 28 of the barrel 7 are respectively divided into two sections 19, 21 and 22, 23.

In place of the division represented, another number and arrangement (for example asymmetric) of the sections 19, 21, 22, 23 is also possible.

In the following descriptions respectively only one half 28 of the cylinder 1 is described and represented for the sake of simplicity. In relation to an axis of rotation of the cylinder 1, the cylinder 1 is represented in the non-actuated initial position, i.e. with an undivided barrel 7, in the upper portion of respectively one drawing figure, and in the lower portion the cylinder 1 is represented in the actuated state, i.e. with the barrel 7 divided.

The barrel 7 of the divisible cylinder 1 (FIG. 5) is put together from individual cylindrical sections 22, 23. The ends of two facing sections 22, 23 rest directly on each other and can be displaced in the axial direction for dividing the barrel 7, so that these sections 22, 23 are spaced apart from each other and a circular groove 33 is created between the ends of adjacent sections 22, 23.

Figure 5:
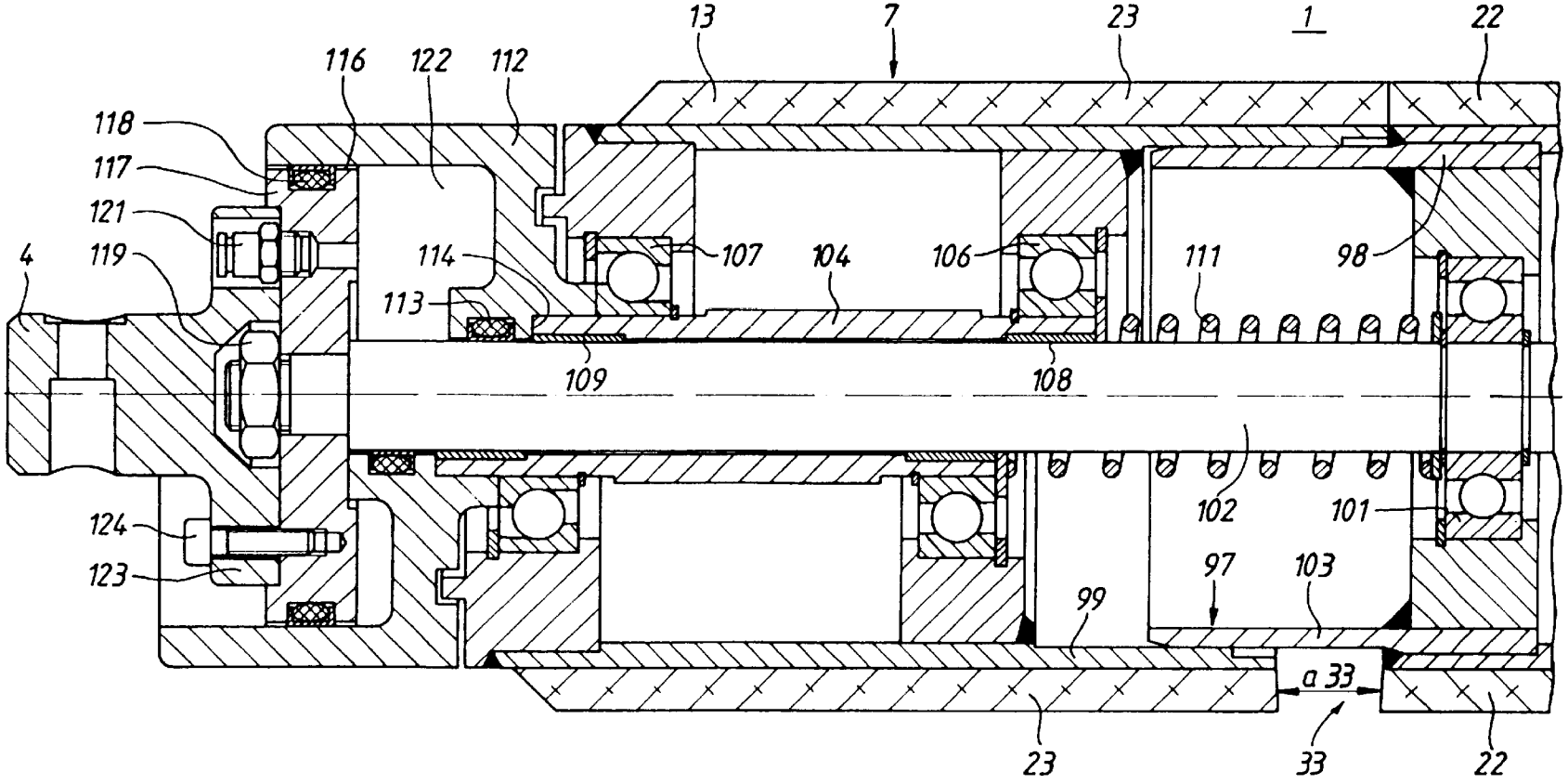
FIG. 5, a schematic longitudinal section through a first exemplary embodiment of a cylinder.

A first exemplary embodiment of a cylinder 1 is represented in FIG. 5.

Here, the cover 13 of the barrel 7 is divided into partial elements 22, 23 which can be displaced in respect to each other. For example, a support tube 97 of the coatings 13 is divided into two partial elements 98, 99.

The "stationary" partial element 98 of the support tube 97 is rotatably seated on a shaft 102, for example by means of a rolling bearing 101, and is provided with an uncovered shoulder used as a centering collar 103. On its end facing the stationary partial element 98, the displaceable partial element 99 of the support tube 97 is provided with a turned groove, which is matched with little play to the centering collar 103.

The axially displaceable partial element 99 is rotatably seated on a sleeve 104 by means of two rolling bearings 106, 107. This sleeve 104 is seated on two slide bearings 108, 109 and can be displaced on the shaft 102 in the axial direction.

A compression spring 111, which generates a force on the displaceable partial element 99 which is directed away from the stationary partial element 98, is arranged on the shaft 102 between a first end of this sleeve 104 and the rolling bearing of the stationary partial element 98. A cup-like housing 112 is arranged on the shaft 102 on a second end of the sleeve 104 and sealed by means of a seal 113. The housing 112 is provided with a shoulder 114, which presses against the front of the sleeve 104. The housing 112, which is open in the direction toward the journal 4, is provided with a bore 116, to which an exterior diameter of a disk 117 is matched. On its surface the disk 117 has a seal 118, which is used for sealing the disk 117 against the housing 112. This disk 117 is fastened in an axially immovable manner by means of a threaded nut 119 on a shoulder at the end of the shaft 102. On its exterior flat side, the disk 117 is provided with a connector 121 for the supply of pressure medium to. a chamber 122 formed by the disk 117 and the housing,112. The journal 4, which has a flange 123, has been screwed to the flat side of the disk 117 by means of threaded screws 124.

In the pressureless state of the chamber 112, the compression spring 111 pushes against the sleeve 104. This sleeve 104 moves the displaceable partial element 99 axially away from the stationary partial element 98 in the direction of the journal 4. Simultaneously the sleeve 104 also pushes against the housing 112, which is axially displaced by this. Thus, the housing 112 moves relative to the disk 117.

Because of the axial movement of the partial element 99, a distance a33 in the shape of a groove 33 is created between the coatings 13 of the first partial element 98 and the second one 99.

In order to obtain a quasi continuous cover 13, i.e. one which is functionally uninterrupted, the two partial elements 98, 99 are pushed together, so that there is no longer a distance a33 between the coatings. To achieve this, the chamber 122 is charged with a pressure medium. By means of this the housing 112 is displaced in relation to the disk 117 in the direction toward the center of the cylinder 1. At the same time the sleeve 104 and the partial element 99 of the support tube 97 are moved in the axial direction by the housing 112.

It is also possible to let at least one cover 22, 23 protrude in the area of the groove 33 past an end of the associated partial element 98, 99 of the support tube 97, which is used as a stop in the state where there is no space between them. For example, it is possible to provide a front face of the cover 22, or respectively 23, located in the area of the groove 33, and of the partial element 98, or respectively 99, with a slight inward cone. As a result, when the partial elements 98, 99 are pushed together, the covers are pressed against each other and deformed. A possibly resulting arching is removed by grinding it down in the pressed-together state.

Figure 6:
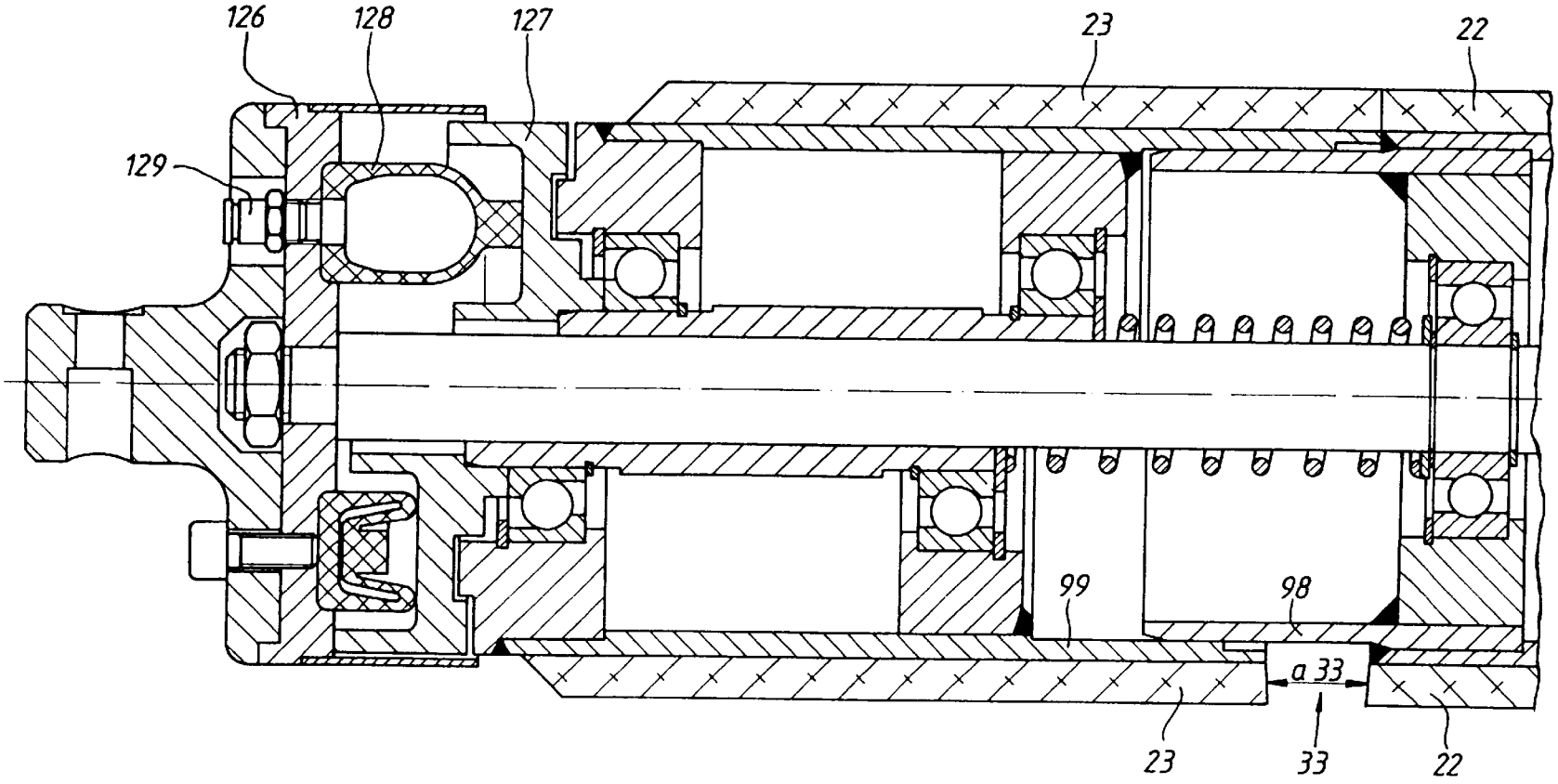
FIG. 6, a schematic longitudinal section through a second exemplary embodiment of a cylinder.

In a second exemplary embodiment (FIG. 6) of the cylinder 1, the space between the disk 126 and the housing 127 is not directly acted upon by the pressure medium, instead an endless ring-shaped hose 128 is arranged between the disk 126 and the housing 127. This hose 128 is connected with a connector 129 for supplying a pressure medium. The displacement of the two partial elements 98, 99 in relation to each other takes place in a manner corresponding to the first exemplary embodiment represented in FIG. 5.

Figure 7:
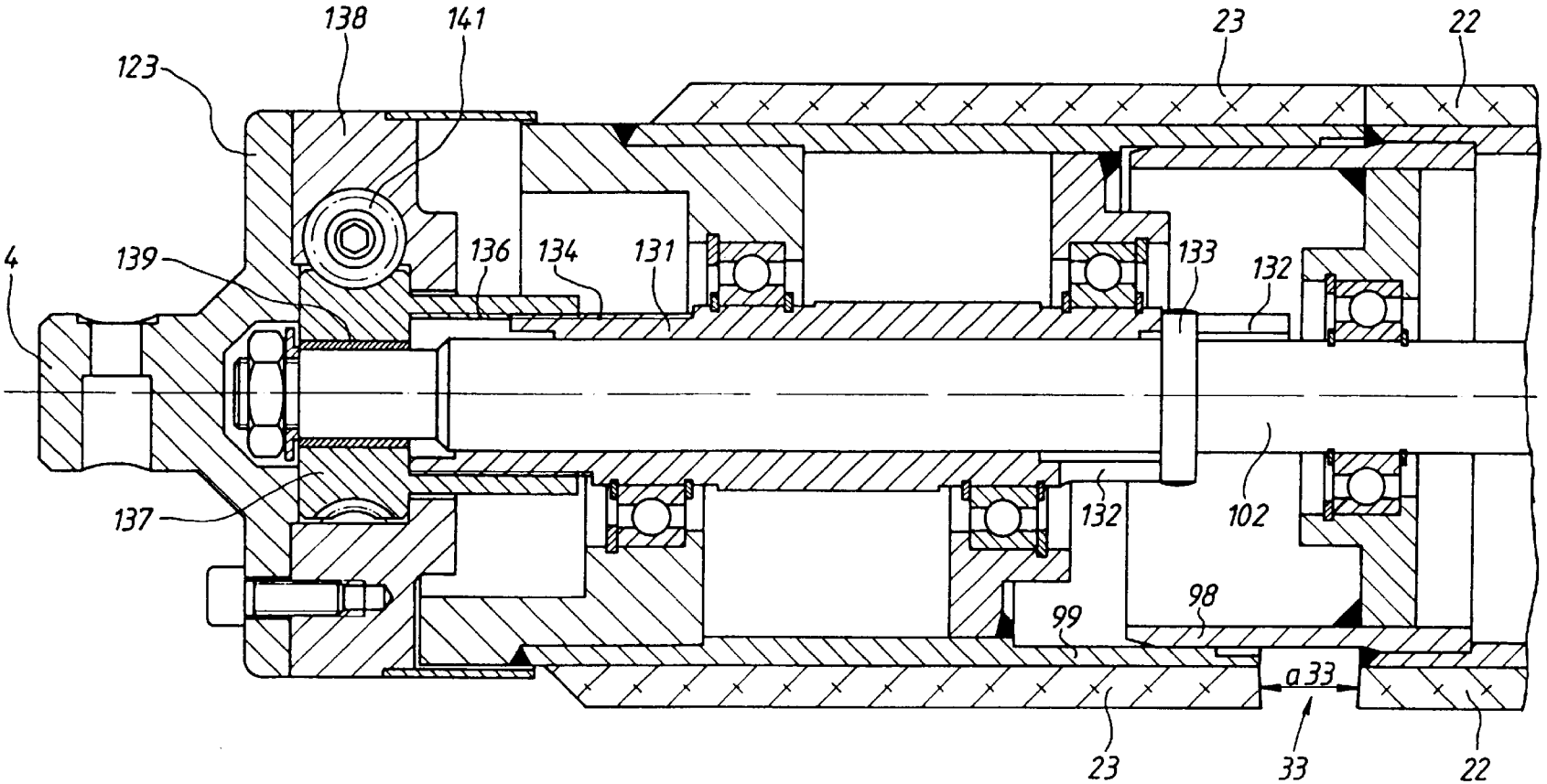
FIG. 7, a schematic longitudinal section through a third exemplary embodiment of a cylinder.

A third exemplary embodiment (FIG. 7) of a cylinder 1 employs a threaded spindle 131 for the axial displacement of the displaceable partial element 99. A sleeve-like threaded spindle 131 is provided here, similar to the sleeve 104 of the first two examples. On its end pointing toward the center of the cylinder 1, this threaded spindle 131 is embodied with axially extending slits 132. A pin 133, which radially projects through the shaft 102, engages these slits 132, so that the threaded spindle 131 is axially movable, but cannot be turned. The threaded spindle 131 has an exterior thread 134 on the opposite end. An interior thread 136 of a worm wheel 137 is screwed on this exterior thread 134. This worm wheel 137 is rotatably seated between the flange 123 of the journal 4 and a bearing shell 138 fastened thereon, but is seated fixed in place in the axial direction by means of a slide bearing 139 on the shaft 102.

A worm 141 engages this worm wheel 137. This worm 141 is seated in the bearing shell 138 tangentially in relation to the worm wheel 137 and fixed in place in the axial direction, but is rotatable. A hexagon socket is attached to the worm 141 for turning the worm 141.

The worm 141 is turned to displace the two partial elements 98, 99 in relation to each other. This turning movement is transferred to the worm wheel 137. By means of this, and with the worm wheel 137 fixed in place, the threaded spindle 131 is screwed into or out of the worm wheel 137. The distance a33 between the two partial elements 98, 99 is changed in accordance with the position of the threaded spindle 131.

In the above exemplary embodiments (FIGS. 5, 6, 7), the ends of the partial elements 98, 99 of the support tube 97 end flush with the sections 22, 23 of the coating 13. The ends of the sections 22, 23 are placed at right angles in respect to the surface in the area of the groove 33. However, it is also possible to let the sections 22, 23 project past the partial elements 98, 99.

With the second type of cylinders 1, a rubber-elastic coating 13 is not absolutely necessary for dividing the cylinder 1. Thus, this way of dividing cylinders can also be employed on chromium or polyamide resin cylinders (for example distributing cylinders with "hard" coating).

The individual sections 19, 21, 22, 23 of each cylinder 1 of the invention have exterior diameters of the same size, and their surface area 9 is seated concentrically in respect to an axis of rotation of the cylinder 1.

In a first operating mode, the cylinders in accordance with the invention are divided into at least two adjacent cylinder-shaped sections 19, 21, 22, 23 by at least one circular ring-shaped depression (for example the groove 33). In a second operating mode, this depression 33 is removed for forming a functionally uninterrupted surface area 8, 9. With the cylinders 1, the displaceable partial element 99 is pushed against the stationary partial element 98 of the support tube 97 for this purpose, so that the sections 19 and 21, or respectively 22 and 23, rest against each other without a gap.

The groove 33 can also extend inclined in respect to the axis of rotation, i.e. along their circumference, the associated front faces of the sections 19, 21, 22, 23 are at different distances from the center line 12.

The beveled front faces can also have any arbitrary course deviating from a straight line. For example, with a zig-zag-shaped course, the sections engage each other in the manner of teeth.

What is claimed is:

1. A cylinder for a rotary printing press comprising:

a cylinder barrel having at least first and second adjacent cylinder barrel sections;

a separate resilient cover for each of said at least first and second adjacent cylinder barrel sections;

means supporting each of said at least first and second adjacent cylinder barrel sections for axial displacement with respect to each other, said at least first and second adjacent cylinder barrel sections being positioned, in a first operating mode, at a spaced distance and being positioned, in a second operating mode, with said resilient covers forming a functionally uninterrupted cylinder surface area;

a groove on said cylinder barrel defined by a space between said separate resilient covers for said at least first and second adjacent cylinder barrel sections when said at least first and second adjacent cylinder barrel sections are in said first operating mode position;

a front face on each of said separate resilient covers adjacent said groove, at least one of said front faces protruding into said groove, said front faces of said resilient covers, when said at least first and second adjacent cylinder barrel sections are in said second operating mode position, being pressed against each other and being deformed radially outwardly;

a housing on the cylinder adjacent said cylinder barrel and in engagement with one of said at least first and second adjacent cylinder barrel sections;

a fluid receiving chamber in said housing; and means supplying fluid to said chamber to shift said housing to move said at least first and second adjacent cylinder barrel sections to said second operating mode position.

2. The cylinder of claim 1 further including a support tube for each of said cylinder barrel sections, each of said support tubes having an end, said support tube ends of said adjacent cylinder barrel sections defining said groove located between said at least first and second adjacent cylinder barrel sections, said front face of at least one of said resilient covers for said at least first and second adjacent cylinder barrel sections projecting past its associated one of said support tube ends into said groove.

3. The cylinder of claim 1 wherein at least one of said resilient covers has its front face provided with an inward cone shape.

4. A method for producing a cylinder for a rotary printing press including:

providing a cylinder barrel;

forming said cylinder barrel having at least first and second adjacent cylinder barrel sections;

providing a resilient cover on each of said at least first and second adjacent cylinder barrel sections;

supporting at least one of said at least first and second adjacent cylinder barrel sections for axial displacement on said cylinder selectively between a first operating position and a second operating position;

spacing said resilient covers from each other in said first operating position;

positioning said resilient covers for forming a functionally uninterrupted cylinder barrel cover surface area in said second operating position;

providing a front face on each of said resilient covers;

forming at least one of said front faces with an inward taper;

pressing adjacent ones of said front faces of said resilient covers together in said second operating position;

deforming said resilient covers radially outwardly in the areas of said front faces and forming a cover arch during said pressing of said resilient covers together; and grinding down said cover arch.

* * * * *